United States Patent [19]

Lee et al.

[11] Patent Number: 4,875,410

[45] Date of Patent: Oct. 24, 1989

[54] DECORATING BOWLING BALLS

[75] Inventors: Andrew J. Lee, Hopkinsville, Ky.; Mohan L. Sanduja, Flushing, N.Y.; Kenneth Sugathan, Piscataway, N.J.; Felicia Dragnea, Forest Hills; Carl Horowitz, Brooklyn, both of N.Y.

[73] Assignee: Ebonite International, Inc., Hopkinsville, Ky.

[21] Appl. No.: 148,002

[22] Filed: Jan. 25, 1988

[51] Int. Cl.[4] ..... B41F 17/00; B41M 1/10; B44C 1/16; B05D 3/12

[52] U.S. Cl. ..... 101/170; 101/41; 101/163; 101/491; 156/230; 156/249; 427/355

[58] Field of Search ..... 101/33, 34, 35, 41, 101/44, 469, 420, 471, 472, 473, 211, 170, 129, 426, DIG. 1, DIG. 2, DIG. 17, 163, 491; 156/230, 240, 241, 247, 249, 289, 277, 307.3, 307.4, 307.1, 542, 493, 581; 427/150, 151, 355

[56] References Cited

U.S. PATENT DOCUMENTS

| | | | |
|---|---|---|---|
| 1,286,205 | 12/1918 | Beaver | 101/DIG. 17 |
| 3,967,021 | 6/1976 | Weingrad | 156/230 |
| 3,990,932 | 11/1976 | Dupire | 156/230 |
| 4,145,465 | 3/1979 | Sanderson et al. | 156/230 |
| 4,263,077 | 4/1981 | Rampelberg | 156/277 |
| 4,511,425 | 4/1985 | Boyd et al. | 156/542 |
| 4,735,854 | 4/1988 | Lauchenauer | 156/289 |

FOREIGN PATENT DOCUMENTS

| | | | |
|---|---|---|---|
| 178787 | 11/1982 | Japan | 101/211 |

OTHER PUBLICATIONS

Preparative Methods of Polymer Chemistry, 2nd Ed.—Sorenson et al., ©1968, J. Wiley & Sons Inc., N.Y., N.Y.

*Primary Examiner*—Michael W. Ball
*Assistant Examiner*—Louis Falasco
*Attorney, Agent, or Firm*—Kinzer, Plyer, Dorn, & McEachran

[57] ABSTRACT

A bowling ball, rather than being engraved with a decoration, is printed with the decoration, relying on graft polymerization chemistry by which the printing fluid, offset to the ball in decoration form, is effectively bonded to the ball which may be rubber or other polymer capable of participating in graft polymerization.

2 Claims, 1 Drawing Sheet

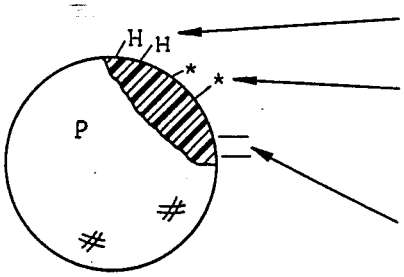

1. Cleanse shell of polymer backbone (P) having abstractable hydrogen sites, H.

(2) Remove (abstract) H with G.I. (e.g. Ag) and simultaneously couple cross linkable graft polymer (via A+B) to abstracted H sites (*) of P, resulting in decoration, which is (3) $P-(CH_2-\underset{\underset{x}{|}}{CH})_{(m+n+2)}-P$ (4) Cure decoration (3) by cross linking x sites with cross linking prepolymer, e.g. aliphatic polyisocyanate Here:

P = bowling ball polymer surface
G.I. = graft initiator
A = same as A, Example 1
B = same as B, Example 1
* = H removed

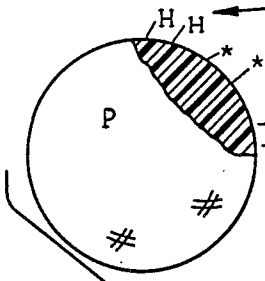

1. Cleanse shell of polymer backbone (P) having abstractable hydrogen sites, H.

(2) Remove (abstract) H with G.I. (e.g. Ag) and simultaneously couple cross linkable graft polymer (via A+B) to abstracted H sites (*) of P, resulting in decoration, which is (3) $P\text{-}(CH_2\text{-}\underset{\underset{x}{|}}{CH})_{(m+n+2)}\text{—}P$ (4) Cure decoration (3) by cross linking x sites with cross linking pre-polymer, e.g. aliphatic poly-isocyanate Here:

P = bowling ball polymer surface
G.I. = graft initiator
A = same as A, Example 1
B = same as B, Example 1
* = H removed

Fig. 1.

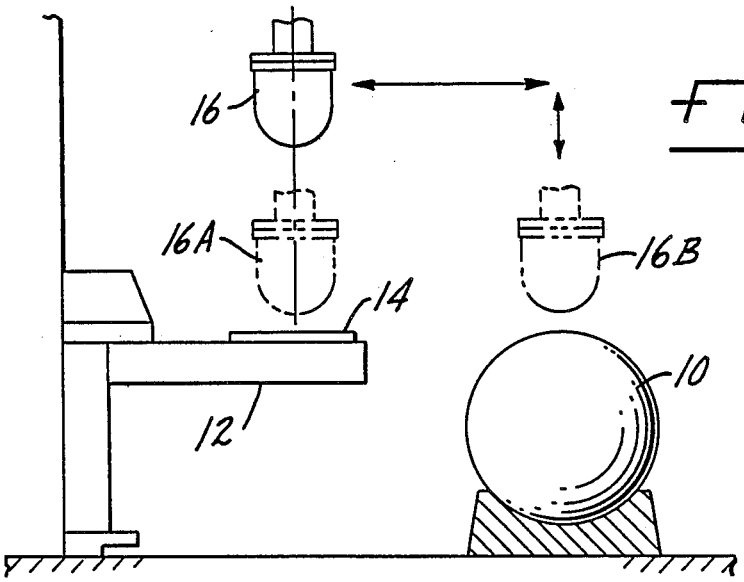

Fig. 2.

DECORATING BOWLING BALLS

INTRODUCTION

This invention relates to decorating bowling balls having at least an outer shell of polyester, polyurethane or rubber. The decoration coating (a replacement for engraving) is formulated using technology of chemical grafting that involves the use of monomers, prepolymers, catalyst and graft initiator system along with pigments. The coating is so formulated that when applied to the bowling ball substrate, it bonds thereto by graft polymerization thereby giving a strong and permanent adhesion to the surface of the substrate material. The monomers and prepolymers are so chosen that when grafted onto the surface they do not alter the performance of the ball.

THE PROBLEM

Of considerable importance is the cost of engraving a blowing ball with personal names (owner), trademarks, designs and other decorations. Mere printing or stamping such decoration, as practiced heretofore, is not durable, hence the skill of an engraver comes into play which is slow and expensive. The engraving cannot be accomplished fast enough to keep pace with inventory turnover.

OBJECTS

In view of the above, one of the main objectives of this invention is to decorate a bowling ball with an organic coating formulation which should have the following characteristics:

1. Will graft onto polyurethane, polyester and rubber bowling balls.
2. May be employed in pad or silk screening printing to eliminate engraving.
3. Will not alter the performance of the ball.

The graft coating is developed using technology of chemical grafting that involves the use of monomers, prepolymers, catalyst, graft initiator system along with other fillers of the composition.

The present invention when practiced in one form involves decorating the surface of the ball with a protective coating by chemically grafting organic monomers and prepolymers, forming a strong bond to the ball surface. The polyfunctional monomers and prepolymers are vinyl monomers, polyester, and acrylic prepolymers which are believed to be chemically bonded to the polyurethane, polyester and rubber balls via free radical mechanism. The monomers are preferably acrylic monomers having one or more hydroxyl, carboxyl and glycidyl groups. Some of the monomers of this type are the following:

Hydroxy ethyl methacrylate
Hydroxylpropyl methacrylate
Methyl methacrylate
Butyl methacrylate
Glycidyl methacrylate
Butyl acrylate The process of grafting involves, preferably, the use of silver ions as graft initiators for the grafting of desired monomers/prepolymers onto the bowling ball surface to be protected, but other metal ions such as $Fe^{+++}$/, $Co^{++}$, $Cu^{++}$ could also be used as graft initiators.

The presence of a small amount of a peroxide as benzoyl peroxide or methyl ethyl ketone peroxide or t-butyl perbenzoate helps to regenerate the graft initiator system in the process which in turn provides free radicals for further chain graft polymerization.

THE DRAWING

FIG. 1 is a view of a partly sectioned bowling ball and wherein the steps for printing the ball under the present invention are broadly outlined;

FIG. 2 is a diagrammatic view of equipment which may be used to print the ball.

MECHANISM OF CHEMICAL GRAFTING

A. As Applied to Natural And Polymeric Substrates

Chemical grafting involves the activation of the substrate. Once the substrate has been activated, chains of monomers linked by carbon-carbon bonds grow on the substrate as whiskers, bonding to the substrate without damaging any of the existing positive characteristics of the materials involved. Many materials, both naturally occurring and synthetic, possess active hydrogens which are more reactive than the "bulk hydrogens," the tertiary hydrogen in polypropylene for example.

Thus, graft initiators (G.I.) have the capacity of removing these active hydrogens and concomitantly initiating the growth of polymer chains at the site from where the active hydrogen was removed. In the case of polypropylene, this can be represented as follows:

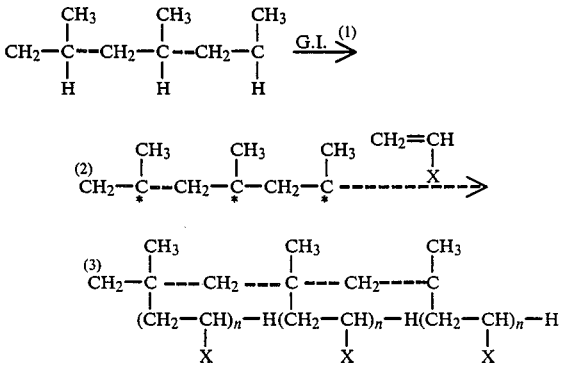

In this illustration * can represent either a free radical, anion or cation, depending on whether the G.I. removes a hydrogen and one electron, no electrons or two electrons, respectively. (There are a wide variety of monomers which do not lend themselves to the free-radical type of polymerization. The fact we can use all three mechanisms widely broadens the scope of application of this method). $CH_2{=}CHx$ represents a unit of vinyl monomer where "x" governs the property or properties obtained. In many instances a mixture of monomers is employed and often more than one property can be altered in one processing step. These polymer chains, whose length can be controlled, are permanently attached to the bowling ball "substrate." The linkage between the graft-polymer and the substrate is covalent in nature, therefore, the graft-polymer cannot be leached from the substrate. In essence chemical grafting is a matter of growing polymer chains on the backbone chain of a substrate. The graft polymer chains are formed from vinyl monomers or monomers containing appropriate functionality, e.g. groups such as hydroxyl, carboxyl, epoxy, amide, amine, anhydride.

B. Chemical Grafting As Applied To Polyurethane Substrate Bowling Ball Material

In the case of a urethane substrate, the chemical grafting is carried out via the abstraction of the hydrogen atom of the imino (—NH) group of the molecule. The hydrogen of the —NH group may be removed with the graft initiator to form a free radical (*) which then reacts with the monomer, by which graft polymerization commences. The series of reaction steps involved in this form of graft polymerization are:

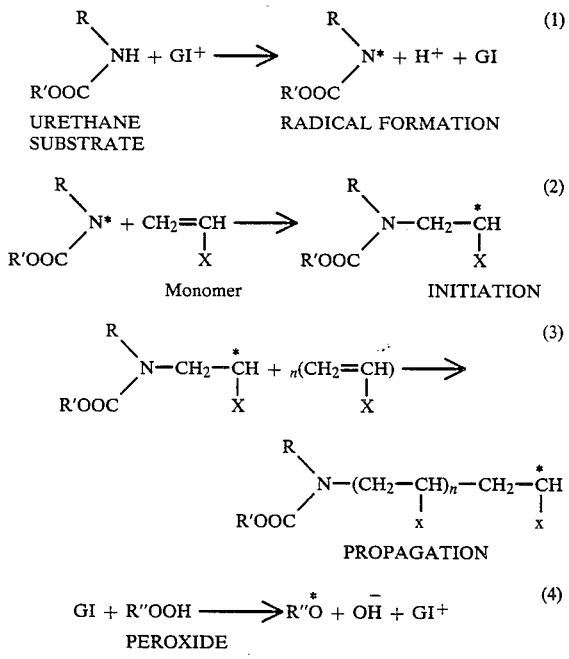

The process may be terminated by radical combination:

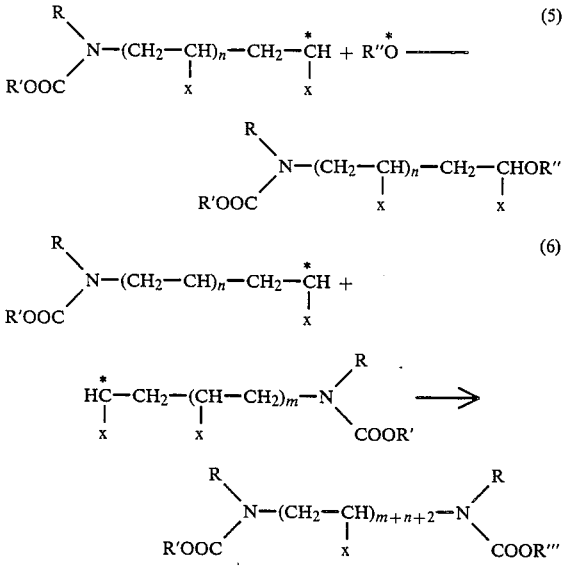

Likewise in the case of a polyester or rubber substrate, the chemical grafting is carried out with the abstraction of the hydrogen atom by the graft initiator and the free radical thus formed undergoes graft polymerization with the desired monomer/prepolymer to form a coating (decoration) on the surface of the bowling ball.

METHOD OF PREPARATION AND APPLICATION OF THE FORMULATION

The process of decorating the bowling balls comprises the steps of cleaning the surface for dust and grease removal (e.g. with MEK and dried) and then applying to the clean surface a solution that contains monomers, prepolymers, graft initiator ions, peroxide ions and other ingredients of the composition. The balls are then dried and the coating cured. The hydroxyl, carboxyl, glycidyl acrylic and/or amine groups in the coating solution polymerize and cross link to form an impervious decoration or coating.

The formulation consists of two parts, part A and part B. Part A contains the desired prepolymer (e.g. polyester) along with pigment fillers and other ingredients while part B is comprised of the curing and cross-linking agents.

A required amount of polyester prepolymer, solvent, fillers and other reagents of Part A are taken in a container, mixed well and the contents subjected to grinding by milling on a pebble roll mill for 24–48 hours. Likewise a required amount of each component of Part B is taken in a container and the contents stirred for 5–10 minutes to a uniform solution. For the preparation of the full formulation, Part A is introduced to Part B in precalculated ratio by weight and the contents mixed again with a mechanical stirrer for 2–3 minutes.

The prepared reactive formulation may then be used to print bowling balls, the print being subjected to a fast cure.

EXAMPLE (PREFERRED EMBODIMENTS)

The following examples illustrate formulations which may be used in the invention; however, the scope of this invention is not limited to the specific details of the examples. In these examples "PM Acetate" is propylene glycol monomethyl ether acetate (ACROSOLVE acetate of ARCO Chemical Company ACROSOLVE being a trademark of the company) and "Catalyst T-12" is liquefied dibutyltin dilaurate of M&T Chemicals. "Modaflow" is a resin flow modifier (registered trademark of Monsanto Co.). It is not essential but even in the small amount specified does improve substrate wetting, adhesion, pigment dispersion and reduces foaming or frothing. The dispersing agent is merely a mixing aid and any preferred dispersant recommended for polymer systems of the kind involved may be employed. The solvents specified are preferred but obviously these may be varied widely both as to species and ratio, especially the 4:1:4:1 solvent system.

Mixed polyesters (Part A) may be used.

EXAMPLE 1—White

| | PBW |
|---|---|
| Part A | |
| Saturated polyester prepolymer | 521.60 |
| Cellulose acetate butyrate solvent (10% in PM acetate) | 32.00 |
| Catalyst T-12, 5% in PM acetate | 3.20 |
| Modaflow, 10% in methyl ethyl ketone (MEK) | 0.15 |
| Methyl methacrylate (monomer) | 3.20 |
| Titanium dioxide (pigment) | 352.00 |
| Cellosolve acetate, butyl acetate, MEK, Xylene 4:1:4:1 (Solvent mixture) | 15.00 |

-continued

| | PBW |
|---|---|
| Dispersing agent | 0.30 |
| Milled and mixed with Part B and Part C (initiator) just before using | |
| Part B | |
| Aliphatic Polyisocyanate | 407.00 |
| Part C | |
| Benzoyl peroxide, 1% in MEK | 5.00 |
| Silver perchlorate or silver nitrate G.I. solution (10–30 ppm) | |
| Mixing ratio Part A: Part B: Part C is 24:10:0.10 | |
| Curing schedule: a short time (e.g. 10 minutes) under UV or infrared light at 140–180° F. | |

EXAMPLE 2—Yellow

This is the same as EXAMPLE 1 except to impart a yellow color to the pigment mixture (PBW =parts by weight) was 270 PBW titanium dioxide and 128 PBW lemon yellow CL-4020 (Ferro Chemical).

In like manner, a blue color may be imparted by mixing titanium dioxide and phthalo blue GS-NF (Sun Chemical); reds and greens are, respectively, lithol scarlet NB4405 (Wyandotte Corp.) and phthalo green U64-2357 (Sun Chemical).

The process steps are broadly set forth in FIG. 1. A physical procedure for printing the ball is shown in FIG. 2. The ball 10 to be imprinted is located in a stationary position, adjacent a support 12 on which a printing plate 14 is accurately secured in a fixed position. The plate whether relief or intaglio bears the indicia (name, fanciful design, quality designation and so on) to be transferred to the ball. The printing or ink fluid set forth in any of the above examples is applied to the plate and excess is squeegeed off, leaving an ink pattern of the decoration.

A very soft resilient pad 16 (rubber-silicone combination) is normally positioned above the plate 14. It is lowered (16A) by pneumatic controls until it is pressed against the wet ink on the plate 14; the ink is transferred decorationwise to pad 16 which is then maneuvered by pneumatic controls to a position where it may be lowered toward the ball (16B) to present the adherent pattern to the ball, which is transferred or offset to the ball by forcefully engaging the pad with the ball. The ball is then transferred to an oven where the decoration is quickly cured (about 10 minutes) in the presence of infrared or ultraviolet light at 140°–180° F.

We have given the preferred modes of practice, especially the chemistry. The monomer is the building block for the polymer. In some instances it may be possible to use monomers alone in obtaining properties equivalent to the combination of monomers and prepolymers since parts A and B when mixed result in a formulation which as a whole contains monomers, along with the cross linking agent, to undergo graft polymerization, forming a polymer giving the desired properties. The equipment shown in FIG. 2 is a diagram of purchased equipment constituting no part of the present invention and clearly equivalent structures may be used. Hence while we have illustrated and described preferred embodiments it is to be understood these are capable of change and variation within the purview of the appended claims.

We claim:

1. A method of decorating a bowling ball, the ball having an outer shell selected from the group consisting of rubber, polyester and polyurethane each presenting in its molecular structure active hydrogens capable of undergoing abstraction for graft polymerization at vacated hydrogen sites, comprising the steps of:

(I) forming a transferable decoration on a first surface and transferring it from said surface to the ball using a transfer carrying means, said deocration having a graft polymerizing and cross-linking composition comprising parts A, B, and C;

part A containing a graft monomer with cross-linkable sites and a graft prepolymer with cross-linkable sites in a solvent therefore;

part B containing a cross-linker and solvent therefor for cross-linking said cross-linkable sites;

part C containing a graft initiator in the form of metal ions to abstract said active hydrogens and transform the abstracted sites into free radical sites to which the cross-linkable monomer and prepolymer of part A couple covalently in a monomer-prepolymer chain;

(II) exposing the ball to infrared or ultraviolet light to quickly complete (1) cross-linking between the graft monomer and prepolymer and (2) grafting cure of the cross-linked monomer and prepolymer to covalently couple by grafting to said molecular structure at the surface of the bowling ball as a decoration for the bowling ball.

2. A method of decorating a bowling ball, the ball having an outer shell selected from the group consisting of rubber, polyester and polyurethane each presenting in its molecular structure active hydrogens capable of undergoing abstraction for graft polymerization at vacated hydrogen sites, comprising the steps of:

(I) applying to a plate, having the decoration for the ball, a polymeric decorating composition which will graft to the surface of the ball and comprising parts A, B and C;

part A containing a graft monomer with cross-linkable sites and a graft prepolymer with cross-linkable sites in a solvent therefor;

part B containing a cross-linker and solvent therefor for cross-linking said cross-linkable sites;

part C containing a graft initiator in the form of metal ions to abstract said active hydrogen sites and transform the abstracted sites into free radical sites to which the monomer and prepolymer of part A couple covalently in a monomer-prepolymer chain;

(II) lifting the decoration composition, in decorative form, from the plate and transferring the so lifted decoration to the ball; and (III) exposing the ball bearing the transferred decoration to infrared or ultraviolet light to complete cross-linking, cure and graft bonding of the decoration resulting in a (1) cross-linked graft polymer which is (2) covalently coupled by graft polymerization to said free radical sites.

* * * * *